US010247103B2

(12) United States Patent
Word et al.

(10) Patent No.: US 10,247,103 B2
(45) Date of Patent: Apr. 2, 2019

(54) ASSEMBLY TOOL KIT FOR GAS TURBINE ENGINE BUNDLED TUBE FUEL NOZZLE ASSEMBLY

(71) Applicant: General Electric Company, Schenectady, NY (US)

(72) Inventors: Paula Marie Word, Simpsonville, SC (US); Lucas John Stoia, Taylors, SC (US); Jeffrey J. Hogan, Pickens, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 475 days.

(21) Appl. No.: 15/241,454

(22) Filed: Aug. 19, 2016

(65) Prior Publication Data

US 2018/0051632 A1 Feb. 22, 2018

(51) Int. Cl.
*F02C 7/22* (2006.01)

(52) U.S. Cl.
CPC ..... *F02C 7/222* (2013.01); *F05D 2220/32* (2013.01); *F05D 2230/64* (2013.01); *F05D 2240/35* (2013.01)

(58) Field of Classification Search
CPC .. F02C 7/222; F05D 2220/32; F05D 2230/64; F05D 2240/35; B21D 39/00–39/206
See application file for complete search history.

(56) References Cited

U.S. PATENT DOCUMENTS

| | | | | | |
|---|---|---|---|---|---|
| 4,204,305 | A * | 5/1980 | Norton | B23P 15/26 | 29/890.043 |
| 5,201,118 | A * | 4/1993 | McParland | B21D 39/06 | 29/402.16 |
| 5,867,551 | A * | 2/1999 | Toshihiko | G21C 3/3206 | 376/313 |
| 6,158,102 | A * | 12/2000 | Berry | F01D 5/06 | 29/281.1 |
| 6,356,614 | B1 * | 3/2002 | Allen | G21C 3/3305 | 376/434 |
| 7,594,400 | B2 * | 9/2009 | Szedlacsek | F23C 13/06 | 60/723 |
| 8,667,683 | B1 * | 3/2014 | Thomas | B21D 39/06 | 29/726 |
| 2017/0107858 | A1 * | 4/2017 | Murphy | F04D 29/522 | |
| 2017/0350321 | A1 * | 12/2017 | Doering | F02C 7/222 | |

* cited by examiner

*Primary Examiner* — Jesse S Bogue
(74) *Attorney, Agent, or Firm* — Dority & Manning, PA

(57) ABSTRACT

The present disclosure is directed to an assembly tool kit for a bundled tube fuel nozzle assembly. The assembly tool kit includes a plurality of pins. Each pin includes a shaft portion, a tapered portion coupled to a first end of the shaft portion, and a contoured portion coupled to a second end of the shaft portion. The contoured portion includes a cylindrical section and a frustoconical section. The tapered and shaft portions of each of the plurality of pins are positioned within a passage defined by one of a plurality of tubes forming a portion of a bundled tube fuel nozzle assembly. The contoured portion of each of the plurality of pins is positioned in one of a plurality of cap plate apertures. Each of the plurality of pins radially aligns one of the plurality of cap plate apertures with a corresponding tube of the plurality of tubes.

20 Claims, 6 Drawing Sheets

ASSEMBLY TOOL KIT FOR GAS TURBINE ENGINE BUNDLED TUBE FUEL NOZZLE ASSEMBLY

FIELD OF THE TECHNOLOGY

The present disclosure generally relates to an assembly tool kit for a gas turbine engine. More particularly, the present disclosure relates to an assembly tool kit for a bundled tube fuel nozzle assembly of a gas turbine engine.

BACKGROUND

A gas turbine engine generally includes a compressor section, a combustion section, a turbine section, and an exhaust section. The compressor section progressively increases the pressure of compressed air entering the gas turbine engine and supplies the compressed air to the combustion section. The compressed air and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected to, e.g., a generator to produce electricity. The combustion gases then exit the gas turbine engine via the exhaust section.

The combustion section may include one or more fuel nozzles. In particular embodiments, the one or more fuel nozzles may be bundled tube fuel nozzles, which premix the fuel and the compressed air upstream from the combustion chamber. In this respect, each of the bundled tube fuel nozzle assemblies generally includes a forward plate, an aft plate, and an outer sleeve, which collectively define a fuel plenum body. A plurality of tubes extends through the forward plate, the fuel plenum body, and the aft plate. In operation, a portion of the compressed air flows through a passage defined by each of the tubes. A portion of the fuel from the fuel plenum is injected into each tube (e.g., via a fuel port in each tube) for premixing with the compressed air therein. The fuel and compressed air mixture then flows through the passages in each of tubes to the combustion chamber.

In some embodiments, the tubes extend downstream from the aft plate. A cap plate located downstream from the aft plate defines a plurality of cap plate apertures through which the plurality of tubes extends. Because the downstream ends of the tubes are free to shift slightly in a radial direction, aligning each of the plurality of tubes for positioning within one of the plurality of cap plate apertures is a time-consuming and expensive process.

BRIEF DESCRIPTION OF THE TECHNOLOGY

Aspects and advantages of the technology will be set forth in part in the following description, or may be obvious from the description, or may be learned through practice of the technology.

In one aspect, the present disclosure is directed to an assembly tool kit for a bundled tube fuel nozzle assembly. The assembly tool kit includes a plurality of pins. Each pin includes a shaft portion having a first end and a second end spaced apart from the first end. A tapered portion couples to the first end of the shaft portion, and a contoured portion couples to the second end of the shaft portion. The contoured portion includes a cylindrical section and a frustoconical section coupled to the cylindrical section. The tapered portion and the shaft portion of each of the plurality of pins are positioned within a passage defined by one of a plurality of tubes collectively forming a portion of a bundled tube fuel nozzle assembly. The contoured portion of each of the plurality of pins is positioned in one of a plurality of cap plate apertures. Each of the plurality of pins radially aligns one of the plurality of cap plate apertures with a corresponding tube of the plurality of tubes.

In another aspect, the present disclosure is directed to a bundled tube fuel nozzle assembly that includes a plurality of tubes. Each of the plurality of tubes defines a passage extending therethrough. The bundled tube fuel nozzle also includes a cap plate defining a plurality of cap plate apertures and a plurality of pins. Each pin includes a shaft portion comprising a first end and a second end spaced apart from the first end. A tapered portion of the pin couples to the first end of the shaft portion, and a contoured portion of the pin couples to the second end of the shaft portion. The contoured portion includes a cylindrical section and a frustoconical section coupled to the cylindrical section. The tapered portion and the shaft portion of each of the plurality of pins are positioned within the passage of one of the plurality of tubes. The contoured portion of each of the plurality of pins is positioned in one of the plurality of cap plate apertures. Each of the plurality of pins radially aligns one of the plurality of cap plate apertures with a corresponding tube of the plurality of tubes.

In a further aspect, the present disclosure is directed to a method of assembling a portion of a bundled tube fuel nozzle assembly. The method includes inserting one of a plurality of pins into a passage of each of a plurality of tubes of a bundled tube fuel nozzle assembly. Each pin includes a shaft portion, a tapered portion coupled to a first end of the shaft portion, and a contoured portion coupled to a second end of the shaft portion. The contoured portion includes a cylindrical section and a frustoconical section. A cap plate defining a plurality of cap plate apertures extending therethrough is positioned onto the plurality of tubes such that each of the plurality of pins extends through one of the plurality of cap plate apertures.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures, in which.

Figure 1:
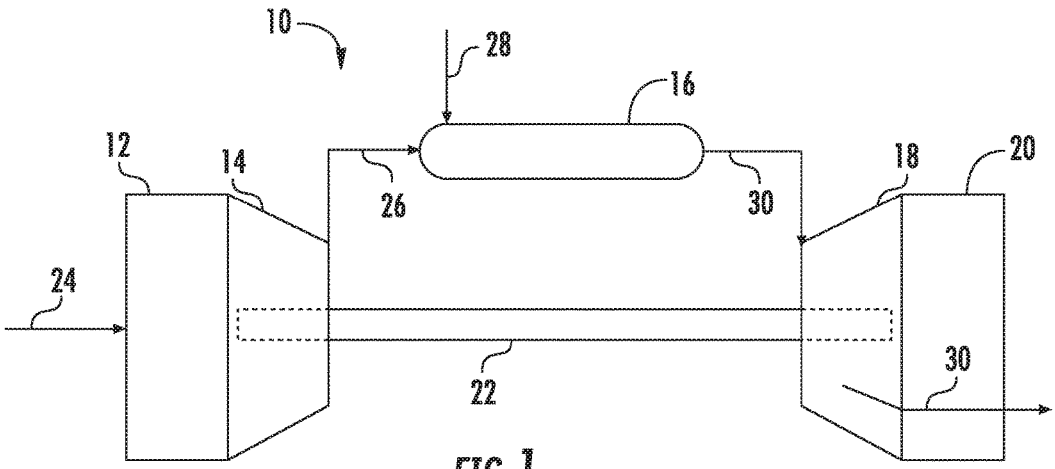
FIG. 1 is a functional block diagram of an exemplary gas turbine that may incorporate various embodiments of the present disclosure.

Repeat use of reference characters in the present specification and drawings is intended to represent the same or analogous features or elements of the present technology.

DETAILED DESCRIPTION OF THE TECHNOLOGY

Reference will now be made in detail to present embodiments of the technology, one or more examples of which are illustrated in the accompanying drawings. The detailed description uses numerical and letter designations to refer to features in the drawings. Like or similar designations in the drawings and description have been used to refer to like or similar parts of the technology. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the technology, not limitation of the technology. In fact, it will be apparent to those skilled in the art that modifications and variations can be made in the present technology without departing from the scope or spirit thereof. For instance, features illustrated or described as part of one embodiment may be used on another embodiment to yield a still further embodiment. Thus, it is intended that the present technology covers such modifications and variations as come within the scope of the appended claims and their equivalents. Although an industrial or land-based gas turbine is shown and described herein, the present technology as shown and described herein is not limited to a land-based and/or industrial gas turbine unless otherwise specified in the claims. For example, the technology as described herein may be used in any type of turbine including, but not limited to, aviation gas turbines (e.g., turbofans, etc.), steam turbines, and marine gas turbines.

The assembly tool kit disclosed herein may be used to assemble a bundled tube fuel nozzle assembly of a gas turbine engine. As will be discussed in greater detail below, bundled tube fuel nozzle assemblies in gas turbine engines typically include a plurality of tubes that extend through a plurality of cap plate apertures. In this respect, the assembly tool kit aligns each of the plurality of tubes with the corresponding cap plate aperture to facilitate assembly of the bundled tube fuel nozzle assembly.

Now referring to the drawings, wherein identical numerals indicate the same elements throughout the figures, FIG. 1 schematically illustrates an exemplary gas turbine engine 10. As depicted therein, the gas turbine engine 10 includes an inlet section 12, a compressor 14, one or more combustors 16, a turbine 18, and an exhaust section 20. The compressor 14 and turbine 18 may be coupled by a shaft 22. The shaft 22 may be a single shaft or formed from a plurality of shaft segments coupled together.

During operation, the gas turbine engine 10 produces mechanical rotational energy, which may be used to generate electricity. More specifically, air 24 enters the gas turbine engine 10 via the inlet section 12. From the inlet section 12, the air 24 flows into the compressor 14, where it is progressively compressed to provide compressed air 26 to each of the combustors 16. The compressed air 26 mixes with a fuel 28 in each of the combustors 16. This compressed air and fuel mixture then burns in each of the combustors 16, thereby producing combustion gases 30. The combustion gases 30 flow through the turbine 18, which extracts kinetic and/or thermal energy therefrom. This energy extraction rotates the shaft 22, thereby creating mechanical rotational energy for powering the compressor 14 and/or generating electricity. The combustion gases 30 exit the gas turbine engine 10 via the exhaust section 20.

Figure 2:
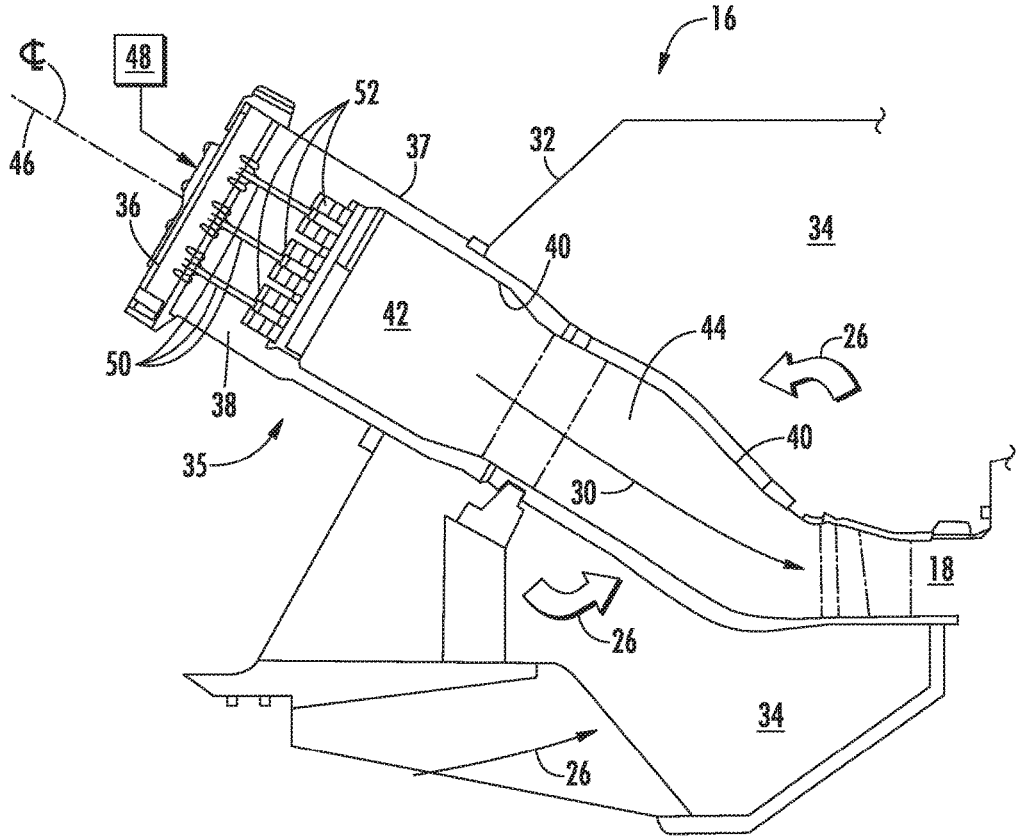
FIG. 2 is a simplified cross-section side view of an exemplary combustor that may incorporate various embodiments of the present disclosure.

FIG. 2 illustrates an exemplary embodiment of one of the combustors 16. More specifically, the combustor 16 includes an outer casing 32, which at least partially defines a high pressure plenum 34 therein. The high pressure plenum 34 is in fluid communication with the compressor 14 (FIG. 1) and receives the compressed air 26 therefrom. An end cover assembly 35, including an end cover 36 and a forward casing 37, couples to the outer casing 32. As such, the end cover 36 and the forward casing 37 collectively define a head end portion 38 of the combustor 16. The head end portion 38 is in fluid communication with the high pressure plenum 34 and/or the compressor 14. One or more liners 40 positioned within outer casing and/or the forward casing 37 partially define a combustion chamber 42 for burning the fuel-air mixture. Furthermore, the one or more liners 40 also partially define a hot gas path 44 through the combustor 16 for routing the combustion gases 30 to the turbine 18. Alternatively, the combustor 16 may have different configurations in other embodiments.

The combustor 16 may include one or more bundled tube fuel nozzle assemblies 52. In the embodiment shown in FIG. 2, the combustor 16 includes three bundled tube fuel nozzle assemblies 52. Nevertheless, the combustor 16 may include more or fewer bundled tube fuel nozzle assemblies 52 as is necessary or desired.

As illustrated in FIG. 2, each of the bundled tube fuel nozzle assemblies 52 is positioned within the head end portion 38 downstream from the end cover 36 and upstream from the combustion chamber 42. In this respect, each of the bundled tube fuel nozzle assemblies 52 are axially spaced between the end cover 36 and the combustion chamber 42. In the embodiment shown in FIG. 2, each of the bundled tube fuel nozzle assemblies 52 is in fluid communication with a gas fuel supply 48 via a fluid conduit 50 coupled to the end cover 36.

Figure 3:
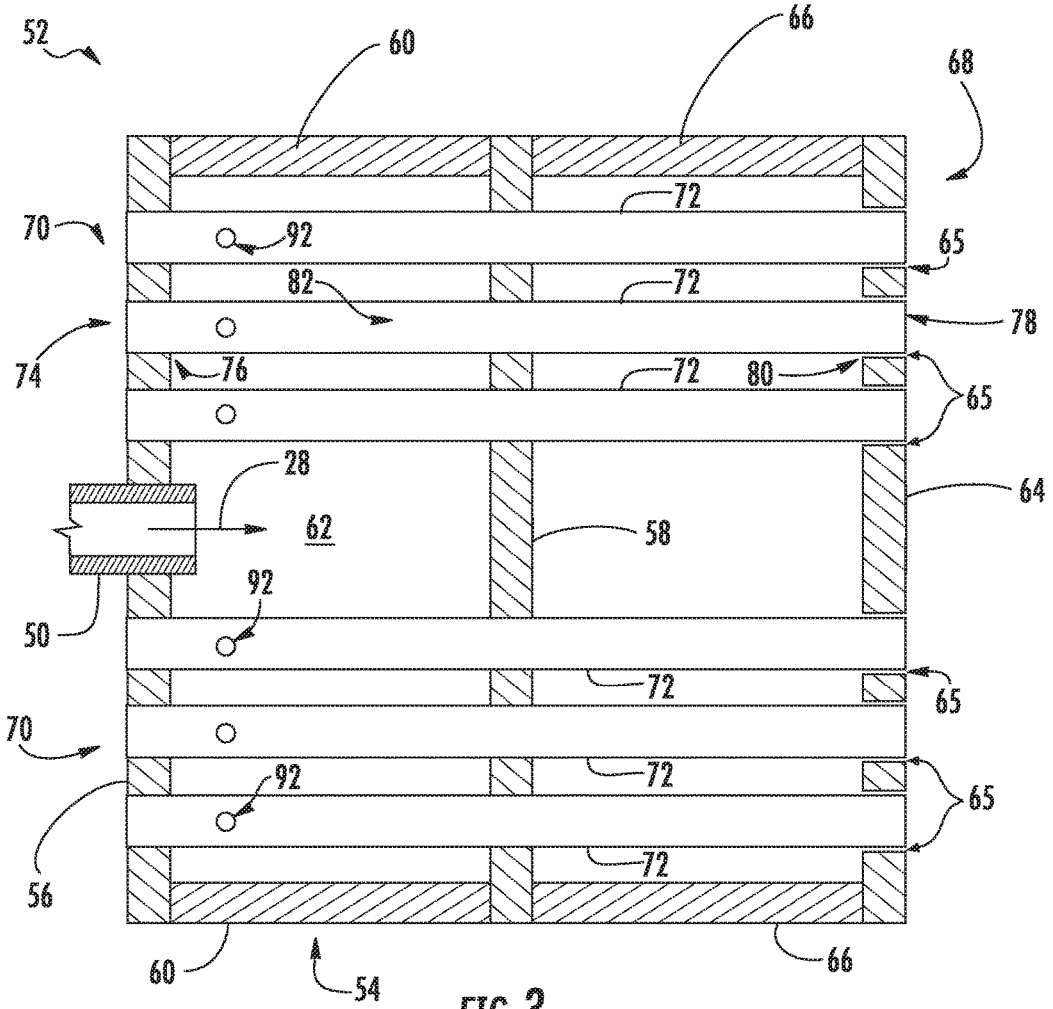
FIG. 3 is a cross sectional side view of a portion of the exemplary bundled tube fuel nozzle assembly shown in FIG. 2, illustrating a plurality of tubes extending through a cap plate assembly.

FIG. 3 is a cross sectional side view of a portion of one of the bundled tube fuel nozzle assemblies 52 shown in FIG. 2. In the embodiment shown in FIG. 3, the bundled tube fuel nozzle assembly 52 includes a fuel plenum body 54. In particular, the fuel plenum body 54 includes a forward plate 56, and aft plate 58, an outer band 60. The aft plate 58 is axially spaced apart from the forward plate 56 along a longitudinal axis 46 of the combustor 16. The outer band 60 extends axially between the forward plate 56 and the aft plate 58. In this respect, the forward plate 56, the aft plate 58, and the outer band 60 collectively form the fuel plenum body 54, which defines a fuel plenum 62 therein. The fluid conduit 50 may extend through the forward plate 56 to provide the fuel 28 to the fuel plenum 62.

In the embodiment illustrated in FIG. 3, the bundled tube fuel nozzle assembly 52 also includes a cap plate assembly 68. More specifically, the cap plate assembly 68 includes a cap plate 64 axially spaced apart from and positioned downstream from the aft plate 58. The cap plate 64 defines a plurality of cap plate apertures 65 extending therethrough. The cap plate assembly 68 further includes a sleeve 66 that extends axially between the aft plate 58 and the cap plate 64.

The bundled tube fuel nozzle assembly 52 also includes one or more tube bundles 70 formed from a plurality of tubes 72. As shown in FIG. 3, each of the plurality of tubes 72 extends through the forward plate 56, the fuel plenum 62, and the aft plate 58. In the embodiment shown in FIG. 3, each of the plurality of tubes 72 also extends through one of the plurality of cap plate apertures 65 defined by the cap plate 64. The cap plate 64 and the sleeve 66 may be formed in segments to house the tubes 72 of a single bundled tube fuel nozzle assembly 52. Alternately, the cap plate 64 may be formed as a single full-face plate with apertures 65 that surround the tubes 72 of all of the bundled tube fuel nozzle assemblies 52, and the sleeve 66 may surround the radially outer perimeter of the bundled tube fuel nozzle assemblies 52.

Figure 4:
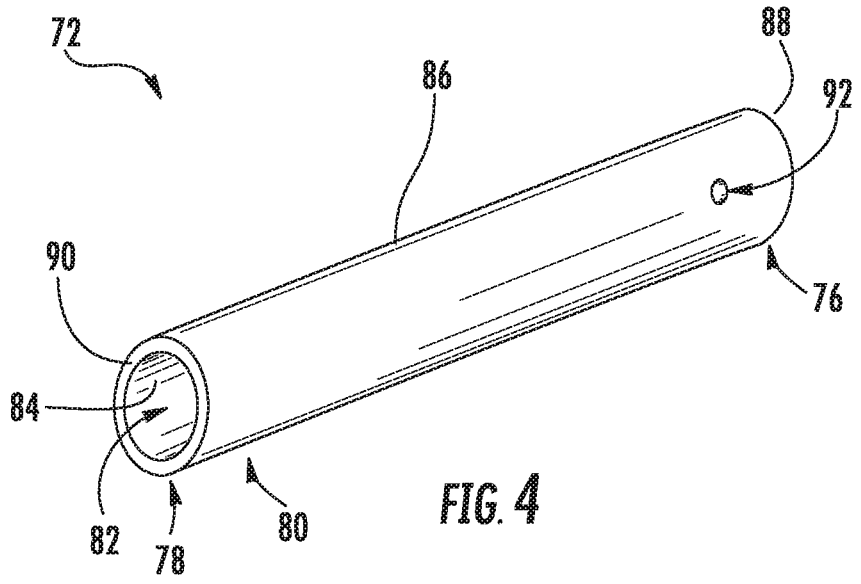
FIG. 4 is a perspective view of one of the plurality of tubes shown in FIG. 3, illustrating the various features thereof.

FIG. 4 illustrates one of the plurality of tubes 72 shown in FIG. 3 in greater detail. Referring now to FIGS. 3 and 4, each of the tubes 72 includes an inlet 74 defined at an upstream end 76 thereof and an outlet 78 defined at a downstream end 80 thereof. In this respect, each of the tubes 72 defines a passage 82 extending from the inlet 74 to the outlet 78. As such, each of the tubes 72 includes an inner surface 84 and an outer surface 86. Furthermore, each of the tubes 72 includes an upstream axial surface 88 positioned at the upstream end 76 thereof. Similarly, each of the tubes 72 includes a downstream axial surface 90 positioned at the downstream end 80 thereof and axially spaced apart from the upstream axial surface 88. Each of the tubes 72 defines at least one fuel port 92 extending from the inner surface 84 to the outer surface 86 that fluidly couples corresponding passage 82 and the fuel plenum 62.

Figure 5:
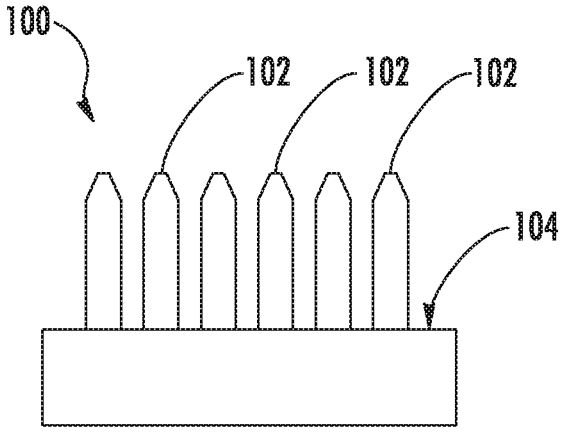
FIG. 5 is a front view of an assembly tool kit for assembling the bundled tube fuel nozzle assembly in accordance with the embodiments disclosed herein.

FIGS. 5-8 illustrate embodiments of an assembly tool kit 100, which may be used to assemble the one or more bundled tube fuel nozzle assemblies 52. Referring particularly to FIG. 5, the assembly tool kit 100 includes a plurality of pins 102. As will be discussed in greater detail below, each of the pins 102 is positioned in the passage 82 of one of the tubes 72 to radially align that tube 72 with the corresponding cap plate aperture 65. In the embodiment shown in FIG. 5, the assembly tool kit 100 includes six pins 102. Nevertheless, the assembly tool kit 100 may include any number of pins 102 so long as the assembly tool kit 100 includes at least two pins 102. Preferably, however, the assembly tool kit 100 includes as many pins 102 as the combustor 16 includes tubes 72. That is, each of the pins 102 in the assembly tool kit 100 may correspond to one of the plurality of tubes 72 in one of the bundled tube fuel nozzle assemblies 52. For example, if the combustor 16 has fuel nozzle assemblies 52 that include two hundred tubes 72 in total, the assembly tool kit 100 may include two hundred pins 102.

As illustrated in FIG. 5, some embodiments of the assembly tool kit 100 may include a holder 104. In particular, the holder 104 includes cavities (not shown) that receive the pins 102. For example, the pins 102 may snap-fit into the cavities in the holder 104. In this respect, the holder 104 may be used to load some or all of the pins 102 into the tube bundle 70 simultaneously as will be discussed in greater detail below. That is, the cavities of holder 104 may be arranged in a similar manner as the passages 82 of the tubes 72. Furthermore, the holder 104 may be used to store the plurality of pins 102 when not in use. The holder 104 is preferably formed from a plastic (e.g., polypropylene) or a hard rubber. Alternately, another similar material capable of rigidly securing the pins 102 throughout the installation of the pins 102 and yet possessing sufficient flexibility to be removed from the pins 102 when the pins 102 are installed may be used.

Figure 6:
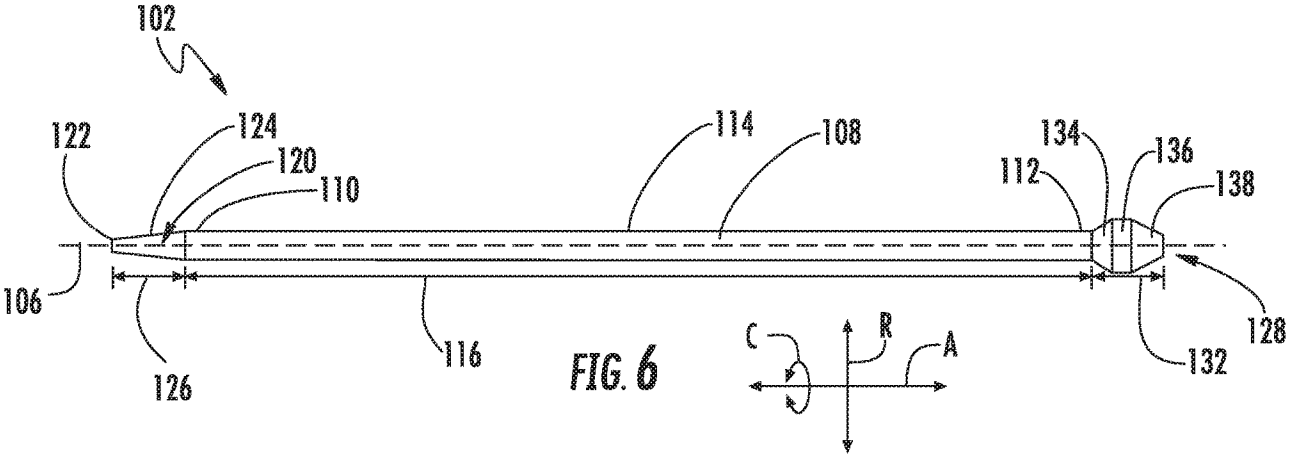
FIG. 6 is a side view of one of the plurality of pins shown in FIG. 5, illustrating a shaft portion, a tapered portion, and a contoured portion thereof.

FIG. 6 illustrates one of the pins 102 shown in FIG. 5 in greater detail. As depicted therein, the pin 102 defines an axial centerline 106. In this respect, the pin 102 defines an axial direction A, a radial direction R, and a circumferential direction C. In general, the axial direction A extends parallel to the axial centerline 106, the radial direction R extends orthogonally outward from the axial centerline 106, and the circumferential direction C extends concentrically around the axial centerline 106.

As illustrated in FIG. 6, each of the pins 102 includes a shaft portion 108. In particular, the shaft portion 108 includes a first end 110 and a second end 112 axially spaced apart from the first end 110. The shaft portion 108 also includes a shaft portion outer surface 114. Furthermore, the shaft portion 106 defines a shaft portion axial length 116 and a shaft portion diameter 118. In the embodiment shown in FIG. 6, the shaft portion diameter 118 is constant although the shaft portion diameter 118 may vary along the shaft portion axial length 116 in other embodiments. The shaft portion diameter 118 is sized to permit slide-fit reception of the pin 102 into the passage 82 of one of the tubes 72. Preferably, the shaft portion 106 has a circular cross-sectional shape; however, the shaft portion 106 may have any suitable cross-sectional shape in other embodiments.

Each of the pins 102 includes a tapered portion 120 coupled to the first end 110 of the shaft portion 108 as shown in FIG. 6. More specifically, the tapered portion 120 extends from the first end 110 of the shaft portion 108 axially outwardly to a blunted tip 122. The diameter of the tapered portion 120 narrows as the tapered portion 120 extends from the first end 110 of the shaft portion 108 to the blunted tip 122, thereby giving the tapered portion 120 a frustoconical shape. This frustoconical shape facilitates easy insertion of the pins 102 into the passages 82 of the tubes 72 as will be discussed in greater detail below. Nevertheless, the tapered portion 120 may have any suitable shape in other embodiments. Furthermore, the tapered portion 120 includes a tapered portion outer surface 124 and a tapered portion axial length 126.

Figure 7:
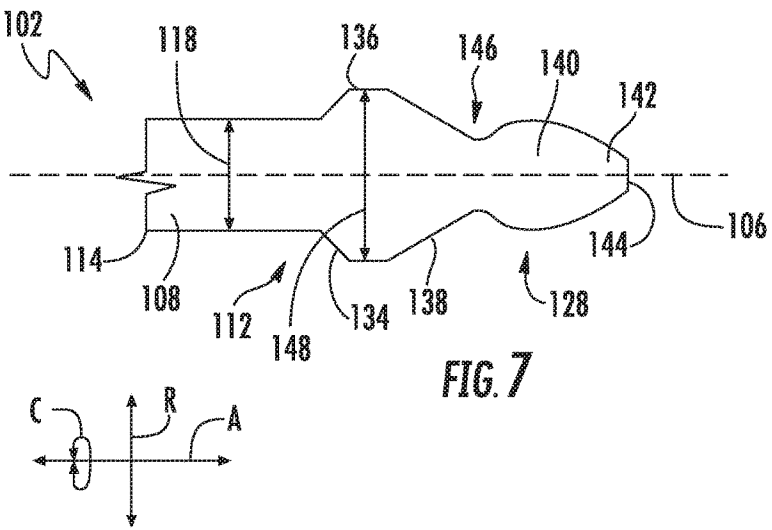
FIG. 7 is an enlarged side of an another embodiment of the contoured portion of the pin, illustrating the various features thereof.
Figure 8:
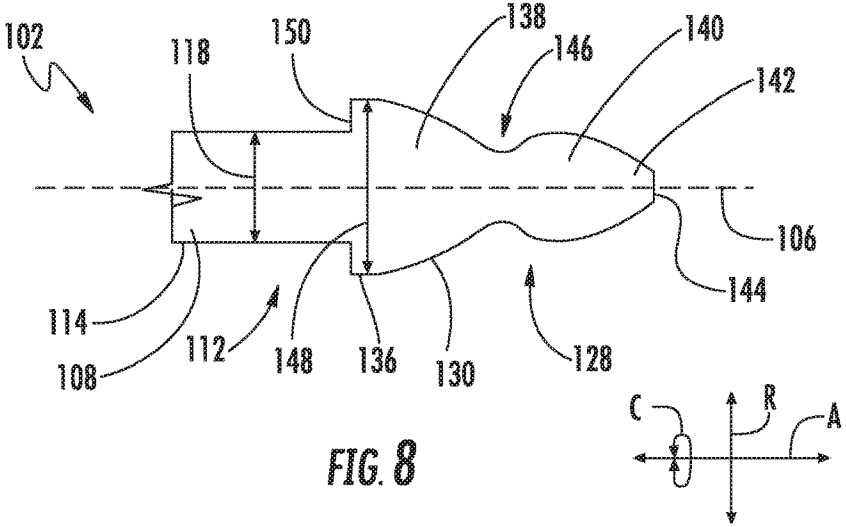
FIG. 8 is an enlarged side of a further embodiment of the contoured portion of the pin, illustrating the various features thereof.

Referring now to FIGS. 6-8, each of the pins 102 includes a contoured portion 128 coupled to the second end 112 of the shaft portion 108. The contoured portion 128 includes a contoured portion outer surface 130 and defines a contoured portion axial length 132.

In the embodiment shown in FIG. 6, the contoured portion 128 includes a chamfered section 134, a cylindrical section 136, and a frustoconical section 138. The chamfered section 134 couples to and extends axially outwardly from the second end 112 of the shaft portion 108. The cylindrical section 136 couples to and extends axially outwardly from the chamfered section 134. The frustoconical section 138 couples to and extends axially outwardly from the cylindrical section 136.

FIG. 7 illustrates another embodiment of the contoured portion 128. Like the embodiment shown in FIG. 6, the embodiment of the contoured portion 128 shown in FIG. 7 includes the chamfered section 134 coupled to the shaft portion 108, the cylindrical section 136 coupled to the chamfered section 134, and the frustoconical section 138 coupled to the cylindrical section 136. The embodiment of the contoured portion 128 shown in FIG. 7 also includes a flared section 140 and a tapered tip 142. In particular, the flared section 140 couples to and extends axially outwardly from the frustoconical section 138. The tapered tip 142 couples to and extends axially outwardly from the flared section 140 to a blunted end 144 thereof As best illustrated in FIG. 7, the diameter of the contoured portion 128 varies along the contoured portion axial length 132. More specifically, the diameter of the contoured portion 128 expands as the chamfered section 134 extends axially outwardly from the second end 112 of the shaft portion 108. As the cylindrical section 136 extends axially outwardly from the chamfered section 134, the diameter of the contoured portion 128 remains constant. The diameter of the contoured portion 128 then narrows as the frustoconical section 138 extends axially outwardly from the cylindrical section 136. In the embodiment shown in FIG. 7, the frustoconical section 138 narrows at a constant rate. That is, the sides of the cross-section of the frustoconical section 138 are linear in the axial direction A. The diameter of the contoured portion 128 then expands as the flared section 140 extends axially outwardly from the frustoconical section 138. In this respect, the narrowing diameter of the frustoconical section 138 and the expanding diameter of the flared section 140 collectively define a groove 146, which may be used to grip the pin 102. The diameter of the contoured portion 128 then narrows as the tapered tip 142 extends axially outwardly from the flared section 140 to the blunted end 144. Although described in the context of the embodiment shown in FIG. 7, the descriptions of the diameter of the contoured portion 128 with respect to the chamfered section 134, the cylindrical section 136, and the frustoconical section 138 are applicable to the embodiment of the contoured portion 128 shown in FIG. 6.

Figure 12:
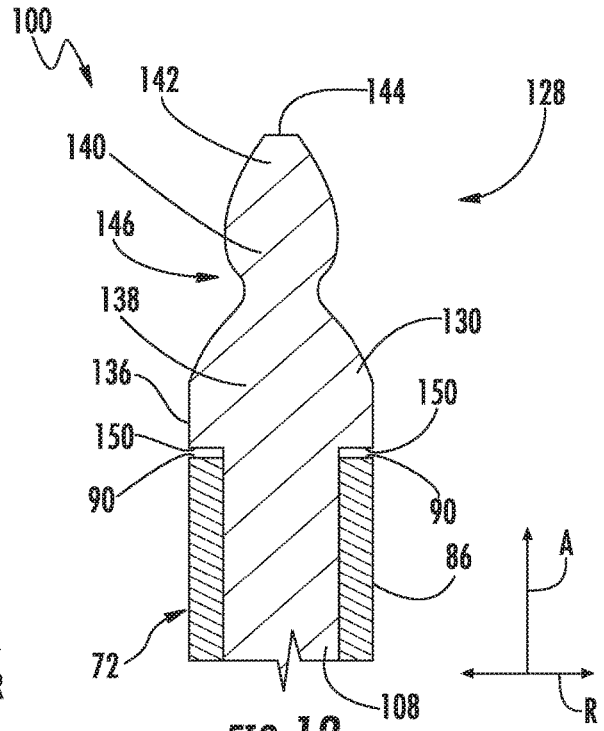
FIG. 12 is an enlarged cross-sectional view of a portion of an alternate embodiment of the assembly tool kit shown in FIG. 10, illustrating the relative positioning between one of the plurality of the pins and one of the plurality of the tubes during assembly of the bundled tube fuel nozzle assembly.

FIG. 8 illustrates a further embodiment of the contoured portion 128. As in the embodiment shown in FIG. 7, the embodiment of the contoured portion 128 shown in FIG. 8 includes the cylindrical section 136, the frustoconical section 138, the flared section 140, and the tapered tip 142. As shown, this embodiment of the contoured portion 128 does not include the chamfered section 128. Instead, the cylindrical section 136 couples to and extends axially outwardly from the second end 112 of the shaft portion 108. In this respect, the contoured portion 128 includes an axial surface 150 extending radially between the shaft portion outer surface 114 and the contoured portion outer surface 130. As such, when the pin 102 is installed within the passage 82 in one of the tubes 72, the axial surface 150 contacts the downstream axial surface 90 of the tube 72 as shown in FIG. 12. Furthermore, the frustoconical section 138 narrows at a varying rate in the embodiment shown in FIG. 8. That is, the sides of the cross-section of the frustoconical section 138 are curvilinear in the axial direction A. Otherwise, the cylindrical section 136, the flared section 140, and the tapered tip 142 are substantially similar the cylindrical section 136, the flared section 140, and the tapered tip 142 shown in FIG. 7.

As illustrated in FIGS. 7 and 8, the contoured portion 128 includes a widest contoured portion diameter 148. More specifically, the widest contoured portion diameter 148 refers to the widest diameter of the contoured portion 128. The cylindrical section 136 includes the widest contoured portion diameter 148 in the embodiments shown in FIGS. 7 and 8. The widest contoured portion diameter 144 is wider than the shaft portion diameter 118 and the diameter of the passage 82 in the corresponding tube 72.

In the embodiment shown in FIG. 6, the shaft portion 108 comprises the majority of the axial length of the pin 102. That is, the shaft portion axial length 116 is longer than the tapered portion axial length 126 and the contoured portion axial length 132 combined. In some embodiments, the shaft portion axial length 116 is at least five times longer than the tapered portion axial length 126 and the contoured portion axial length 132 combined. In alternate embodiments, however, the shaft portion axial length 116 may be shorter than each of the tapered portion axial length 126 and the contoured portion axial length 132. Nevertheless, the shaft portion axial length 116, the tapered portion axial length 126, and the contoured portion axial length 132 may be any suitable lengths.

Figure 10:
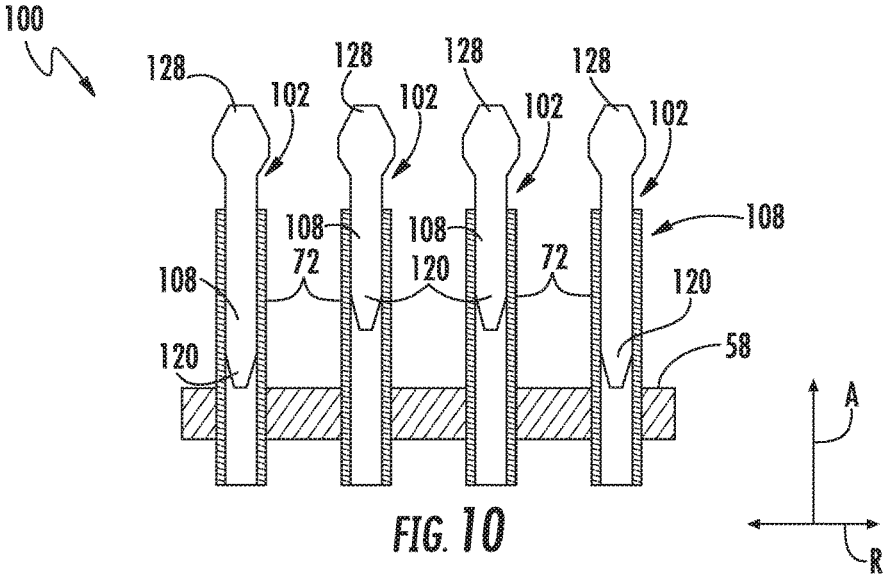
FIG. 10 is a cross-sectional view of the assembly tool kit shown in FIG. 5 after the plurality of pins are positioned in the plurality of tubes.
Figure 13:
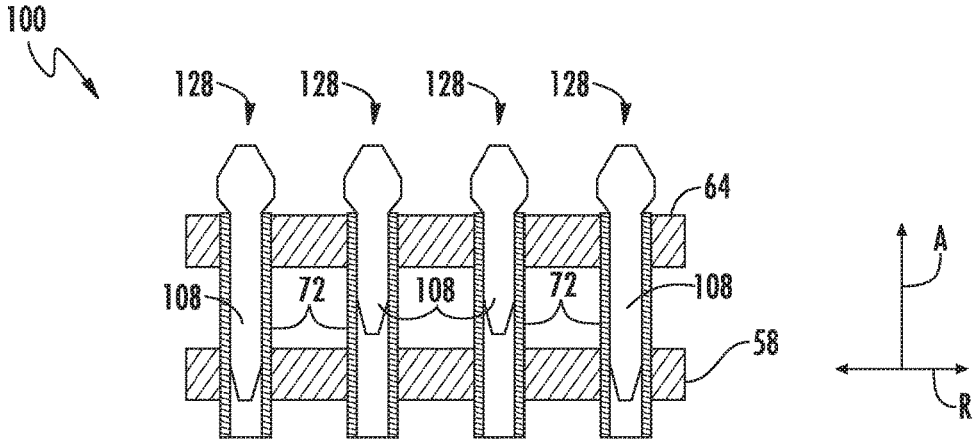
FIG. 13 is cross-sectional view of the assembly tool kit shown in FIGS. 5 and 10 during positioning of the cap plate assembly.

In some embodiments, such as those shown in FIGS. 10 and 13, the plurality of pins 102 may include pins 102 having different axial lengths for use in the same combustor 16. For example, a portion of the plurality of the pins 102 having a longer axial length may be inserted into the tubes 72 located around a perimeter of the combustor 16 to reduce the likelihood of bending of the tubes 72 along the perimeter during assembly. Conversely, a portion of the plurality of pins 102 having a shorter axial length may be used in radially inward portions of the bundled tube fuel nozzle assemblies 52, which are less likely to receive incidental contact during assembly. In this respect, the pins 102 inserted into the two radially outer tubes 102 in FIGS. 10 and 13 have a longer axial length than the pins 102 inserted into the two radially inner tubes 102.

In one embodiment, each of the pins 102 is integrally formed. In this respect, the shaft portion 108, the tapered portion 120, and the contoured portion 128 are all formed as a single component, such as by casting or molding. In another embodiment, the pins 102 may be machined. Alternately, each of the pins 102 may be formed from two or more separate components that are affixed or joined to one another and/or via other suitable manufacturing methods. Each of the pins 102 are preferably formed from a metallic material resistant to bending, but may be made from other suitable materials (e.g., plastic, etc.) instead.

Figure 9:
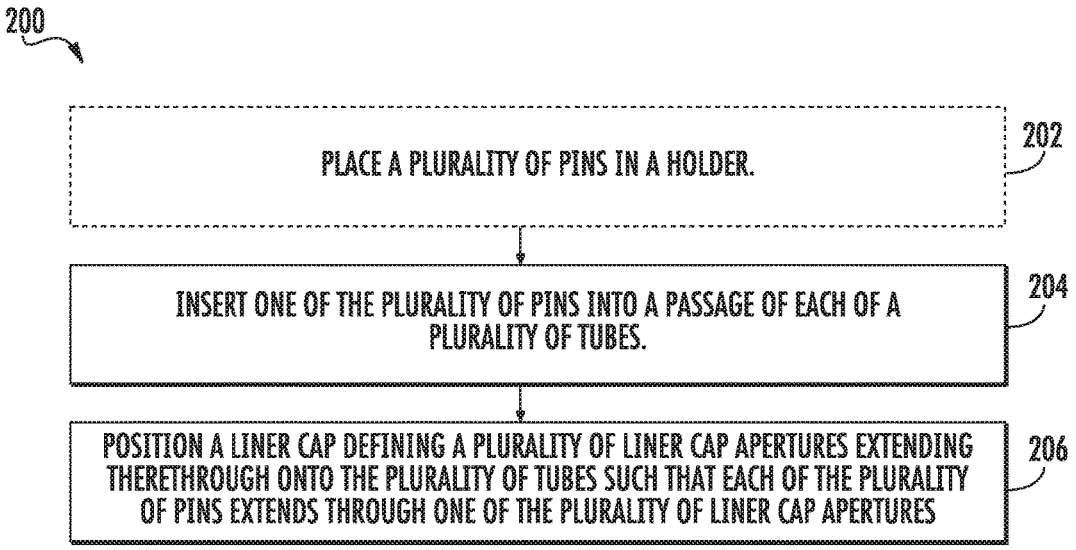
FIG. 9 is a flow chart illustrating a method of using the assembly tool kit for assembling the bundled tube fuel nozzle assembly in accordance with the embodiments disclosed herein.

FIG. 9 is a flowchart illustrating an exemplary method 200 for using the assembly tool kit 100 to assemble the one or more bundled tube fuel nozzle assemblies 52 in accordance with the embodiments disclosed herein.

In optional step 202, the plurality of pins 102 are placed in the holder 104. In particular, each of the pins 104 is placed in one of a plurality of cavities (not shown) defined by the holder 104. After positioning in the cavities, the pins 102 are oriented in an inverted position as shown in FIG. 10 in which the tapered portion 120 extends outward from the holder 104 as shown in FIG. 5. In this respect, the contoured portion 128 of each pin 102 is positioned within the one of the cavities in the holder 104.

In step 204, one of the pins 72 is inserted into the passage 82 of each of the tubes 72. Each of the pins 102 is received in the passage 82 of the corresponding tube 72 in slide-fit reception. In this respect, the inner surfaces 84 of the tubes 72 are in sliding contact with the shaft portion outer surface 114. The groove 146 defined by the contoured portion 128 of each of the pins 102 permits easy gripping and handling thereof during step 204 in instances where the holder 104 is not used. In embodiments including the holder 104, some portion or all of the pins 102 may be inserted into the corresponding tube 72 simultaneously by reversing the orientation of the holder 104 and the pins 102 from the orientation shown in FIG. 5 to the pin orientation shown in FIG. 10.

The tapered portion 120 of each pin 102 facilitates easy insertion of the pin 102 into the corresponding tube 72. More specifically, the blunted tip 122 of the tapered portion 120 of each of the pins 102 is narrower than the diameter of the passage 82 of the corresponding tube 72. In this respect, the size differential between the blunted tip 122 and the corresponding passage 82 makes it easy to insert each pin 102 into the corresponding passage 82. Since the diameter of each tapered portion 120 expands from the blunted tip 122 thereof to the first end 110 of the shaft portion 108, each tapered portion 120 self-centers the corresponding pin 102 within the passage 82 of the corresponding tube 72. That is, the frustoconical shape of each tapered portion 120 guides the corresponding pin 102 into the center of the passage 82 of the corresponding tube 72. FIG. 10 illustrates the plurality of pins 102 positioned in the plurality of tubes 72 after self-centering. That is, upon completion of step (204), the shaft portion 108 and the tapered portion 120 of each of the pins 102 are positioned within the passage 82 of the corresponding tube 72.

Figure 11:
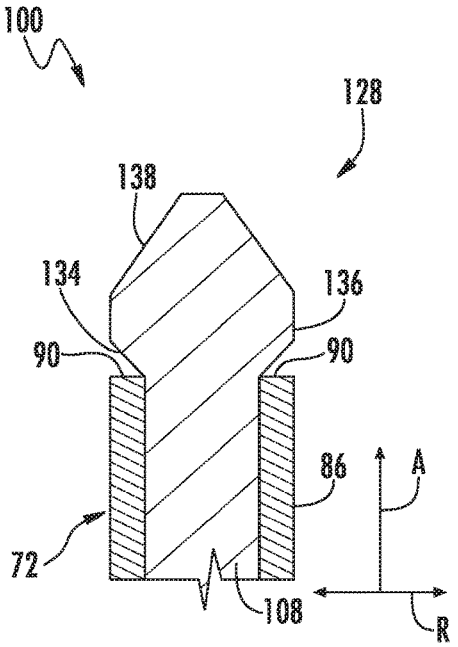
FIG. 11 is an enlarged cross-sectional view of a portion of the assembly tool kit shown in FIG. 10, illustrating the relative positioning between one of the plurality of the pins and one of the plurality of the tubes during assembly of the bundled tube fuel nozzle assembly.

FIG. 11 illustrates the positioning of the contoured portion 128 of one of the pins 102 relative to the corresponding tube 72 during step 204. As mentioned above, the widest contoured portion diameter 148 is greater than the shaft portion diameter 118. In this respect, a portion of the chamfered section 134, the cylindrical section 136, and the frustoconical section 138 of the pin 102 are radially aligned with the tube 72. In fact, the contoured portion 128 extends radially outward from the inner surface 84 of the tube 102. That is, the contoured portion 128 is wider than the diameter of the passage 82 of the tube 102. As such, the contoured portion 128 does not slide into the passage 82 of the tube 72. The downstream axial surface 90 of the tube 102 is in contact with the chamfered section 134 upon completion of step 204.

FIG. 12 illustrates the positioning of the alternate embodiment of the contoured portion 128 of one of the pins 102 shown in FIG. 8 relative to the corresponding tube 72 during step 204. As in the embodiment shown in FIG. 11, a portion of the frustoconical section 138 of the pin 102 is radially aligned with the tube 72. Furthermore, the contoured portion 128 extends radially outward from the inner surface 84 of the tube 102. That is, the contoured portion 128 is wider than the diameter of the passage 82 of the tube 102. As such, the contoured portion 128 does not slide into the passage 82 of the tube 72. For clarity, FIG. 12 shows that the downstream axial surface 90 of the tube 72 is axially spaced apart from the axial surface 146 of the pin 102. In practice, the downstream axial surface 90 is in contact with the axial surface 146 upon completion of step 204.

In step 206, the cap plate 64 is positioned onto the plurality of tubes 72 such that each of the plurality of pins 102 extends through one of the plurality of cap plate apertures 65. As illustrated in FIG. 12, the contoured portion 128 of each of the pins 102 is inserted into one of cap plate apertures 65. In this respect, the shaft portion 108 and the tapered portion 120 of each of the pins 102 are inserted into the passage 82 of the corresponding tube 72, while the contoured portion 128 of each of the pins 102 is inserted and guides the tube 72 into the corresponding cap plate aperture 65.

The plurality of pins 102 radially aligns each of the plurality of cap plate apertures 65 with a corresponding tube 72 of the plurality of tubes 72. As illustrated in FIG. 13, an axially outer end of the frustoconical section 138 of the contoured portion 128 of each of the pins 102 is narrower than the diameter of the corresponding cap plate aperture 65. In this respect, this size differential makes it easy to insert each pin 102 into the corresponding cap plate aperture 65. As mentioned above, the diameter of frustoconical section 138 expands from the axially outer end thereof to the cylindrical section 136. In this respect, each frustoconical section 138 self-centers the corresponding pin 102 within the corresponding cap plate aperture 65. That is, the frustoconical section 138 guides the corresponding pin 102 into the center of the corresponding cap plate aperture 65. FIG. 13 illustrates the plurality of pins 102 positioned in the plurality of cap plate apertures 65 after self-centering. That is, upon completion of step 206, the contoured portion 128 of each of the pins 102 extends through the corresponding cap plate aperture 65.

In embodiments that include the flared portion 140 and the tapered tip 142, such as those shown in FIGS. 7 and 8, the blunted end 144 of the contoured portion 128 of each of the pins 102 is narrower than the diameter of the corresponding cap plate aperture 65 to facilitate insertion of each pin 102 into the corresponding cap plate aperture 65. As mentioned above, the diameter of tapered tip 142 expands from the blunted end 144 thereof to the flared section 140 to self-center the pin in the cap plate aperture 65.

Once the tubes 72 are appropriately guided into respective apertures 65 in the cap plate 64, the cap assembly 68 is secured. At this point, the pins 102 are removed from the tubes 72, either individually (e.g., by gripping the groove 146 by hand or with a tool such as pliers) or by reattaching the holder 104 to the projecting contoured portions 128 of some or all of the pins 72 and extracting multiple pins 72 at once.

The assembly tool kit 100 facilitates quick assembly of the one or more bundled tube fuel nozzle assemblies 52. As discussed in greater detail above, the tapered portion 120 of each of the pins 102 facilitates easy insertion of the pins 102 into the passages 82 of the corresponding tube 72. Similarly, the contoured portion 128 of each of the pins 102 facilitates easy insertion of the pins 102 into the cap plate apertures 65. In this respect, the assembly tool kit 100 reduces the amount of time necessary to radially align each of the cap plate apertures 65 with the corresponding tube 72 compared to conventional assembly tools and/or methods. In this respect, assembly tool kit 100 reduces the cost of assembling the bundled tube fuel nozzle assembly 52 over conventional assembly tools and/or methods.

Furthermore, the assembly tool kit 100 may protect the downstream axial surface 90 of each of the tubes 72 from incidental and/or accidental contact with the cap plate 64. As mentioned above, a portion of the frustoconical section 134 of each pin 102 is radially aligned with the corresponding tube 72. This portion of the pins 102 may cover the downstream axial surfaces 90 of the tubes 72. In this respect, the pins 102 prevent incidental and/or accidental contact between the downstream axial surfaces 90 and the cap plate 64 during, e.g., handling or transportation of the bundled tube fuel nozzle assembly 52.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. An assembly tool kit for a bundled tube fuel nozzle assembly, the assembly tool kit comprising:

a plurality of pins, each pin comprising:

a shaft portion comprising a first end and a second end spaced apart from the first end;

a tapered portion coupled to the first end of the shaft portion; and a contoured portion coupled to the second end of the shaft portion, the contoured portion comprising a cylindrical section and a frustoconical section coupled to the cylindrical section;

wherein the tapered portion and the shaft portion of each of the plurality of pins are positioned within a passage defined by one of a plurality of tubes collectively forming a portion of a bundled tube fuel nozzle assembly;

wherein the contoured portion of each of the plurality of pins is positioned in one of a plurality of cap plate apertures; and wherein each of the plurality of pins radially aligns one of the plurality of cap plate apertures with a corresponding tube of the plurality of tubes.

2. The assembly tool kit of claim 1, wherein the contoured portion comprises a chamfered section coupling the shaft portion to the cylindrical section of the contoured portion.

3. The assembly tool kit of claim 1, wherein the contoured portion comprises a flared section coupled to the frustoconical section.

4. The assembly tool kit of claim 3, wherein the contoured portion defines a groove positioned axially between the frustoconical section and the flared section.

5. The assembly tool kit of claim 3, wherein the contoured portion comprises a tapered tip coupled to the flared section.

6. The assembly tool kit of claim 1, wherein the tapered tip terminates in a blunted end.

7. The assembly tool kit of claim 1, wherein the shaft portion of each of the plurality of pins comprises a shaft portion diameter and the contoured portion of each of the plurality of pins comprises a widest contoured portion diameter, and wherein the widest contoured portion diameter is greater than the shaft portion diameter.

8. The assembly tool kit of claim 7, wherein the cylindrical section of the contoured portion of each of the plurality of pins comprises the widest contoured portion diameter.

9. The assembly tool kit of claim 8, wherein a portion of the frustoconical section of each of the plurality of pins is radially aligned with one of the plurality of tubes.

10. The assembly tool kit of claim 1, wherein the tapered portion of each of the plurality of pins comprises a tapered portion axial length, the shaft portion of each of the plurality of pins comprises a shaft portion axial length, and the contoured portion of each of the plurality of pins comprises a contoured portion axial length, and wherein the shaft portion axial length is longer than the tapered portion axial length and the contoured portion axial length.

11. The assembly tool kit of claim 10, wherein the shaft portion axial length is at least five times longer than the tapered portion axial length and the contoured portion axial length.

12. The assembly tool kit of claim 1, wherein the tapered portion of each of the plurality of pins comprises a tapered portion axial length, the shaft portion of each of the plurality of pins comprises a shaft portion axial length, and the contoured portion of each of the plurality of pins comprises a contoured portion axial length, and wherein the shaft portion axial length is shorter than the tapered portion axial length and the contoured portion axial length.

13. A bundled tube fuel nozzle assembly, comprising:

a plurality of tubes, each of the plurality of tubes defining a passage extending therethrough;

a cap plate defining a plurality of cap plate apertures; and a plurality of pins, each pin comprising:

a shaft portion comprising a first end and a second end spaced apart from the first end;

a tapered portion coupled to the first end of the shaft portion; and a contoured portion coupled to the second end of the shaft portion, the contoured portion comprising a cylindrical section and a frustoconical section coupled to the cylindrical section;

wherein the tapered portion and the shaft portion of each of the plurality of pins are positioned within the passage of one of the plurality of tubes;

wherein the contoured portion of each of the plurality of pins is positioned in one of the plurality of cap plate apertures; and wherein each of the plurality of pins radially aligns one of the plurality of cap plate apertures with a corresponding tube of the plurality of tubes.

14. A method of assembling a portion of a bundled tube fuel nozzle assembly, comprising:

inserting one of a plurality of pins into a passage of each of a plurality of tubes of a bundled tube fuel nozzle assembly, each pin comprising a shaft portion, a tapered portion coupled to a first end of the shaft portion, and a contoured portion coupled to a second end of the shaft portion, the contoured portion comprising a cylindrical section and a frustoconical section; and positioning a cap plate defining a plurality of cap plate apertures extending therethrough onto the plurality of tubes such that each of the plurality of pins extends through one of the plurality of cap plate apertures.

15. The method of claim 14, further comprising:

placing the plurality of pins in a holder before inserting one of the plurality of pins into the passage of each of the plurality of tubes.

16. The method of claim 15, further comprising:

inverting the holder to align the plurality of pins with the plurality of tubes after placing the plurality of pins in the holder.

17. The method of claim 16, further comprising:

separating the holder from the plurality of the pins after inverting the holder.

18. The method of claim 14, further comprising:

removing the plurality of pins from the plurality of tubes after positioning the cap plate.

19. The method of claim 14, wherein the contoured portion comprises a chamfered section coupling the shaft portion to the cylindrical section of the contoured portion, and wherein the inserting of one of the plurality of pins results in the chamfered section contacting an upstream axial surface of a respective tube.

20. The method of claim 14, further comprising:

grasping a groove defined by the contoured portion of each of the plurality of pins to remove the plurality of pins from the plurality of tubes.

* * * * *